US007233679B2

(12) United States Patent
Muthuswamy et al.

(10) Patent No.: US 7,233,679 B2
(45) Date of Patent: Jun. 19, 2007

(54) MICROPHONE SYSTEM FOR A COMMUNICATION DEVICE

(75) Inventors: Sivakumar Muthuswamy, Plantation, FL (US); David Yeager, Boca Raton, FL (US)

(73) Assignee: Motorola, Inc., Schaumburg, IL (US)

( * ) Notice: Subject to any disclaimer, the term of this patent is extended or adjusted under 35 U.S.C. 154(b) by 496 days.

(21) Appl. No.: 10/675,437

(22) Filed: Sep. 30, 2003

(65) Prior Publication Data

US 2005/0069164 A1 Mar. 31, 2005

(51) Int. Cl.
*H04R 25/00* (2006.01)

(52) U.S. Cl. ..... 381/369; 381/356; 381/174

(58) Field of Classification Search ..... 381/355, 381/356, 357, 358, 360, 361, 365, 369, 313, 381/173, 174, 175
See application file for complete search history.

(56) References Cited

U.S. PATENT DOCUMENTS

| | | | | |
|---|---|---|---|---|
| 3,835,263 | A * | 9/1974 | Killion | 381/313 |
| 3,875,349 | A * | 4/1975 | Ruegg | 381/313 |
| 4,142,072 | A * | 2/1979 | Berland | 381/313 |
| 6,421,444 | B1 | 7/2002 | Van Schyndel | |

OTHER PUBLICATIONS

Voice Technology, "Surface Mount Microphone", Wireless Design & Development Apr. 2002, pp. 30-31. www.wirelessdesignmag.com.

The Hearing Review, "A Primer on a Dual Microphone Directional System", by Brian Csermak, Jan. 2000.

* cited by examiner

*Primary Examiner*—Huyen Le
(74) *Attorney, Agent, or Firm*—Barbara R. Doutre

(57) ABSTRACT

A microphone system (100) includes a MEMS microphone (102) and at least one audio port (110) accessing the rear volume portion (106) of the MEMS microphone providing directional functionality, preferably through a MEMS switch (112).

7 Claims, 2 Drawing Sheets

MICROPHONE SYSTEM FOR A COMMUNICATION DEVICE

TECHNICAL FIELD

This invention relates in general to microphone systems, and more particularly to microphone systems for communication devices having both speakerphone mode and close-talking mode.

BACKGROUND

Acoustic performance is an important product differentiator amongst portable cellular telephones. In addition to the traditional operation where the phone is held close to a user's mouth, the newer generation of cell phones offers hands-free speakerphone operation, both to address driving safety concerns as well convenience. A variety of techniques have been developed to detect whether the phone is operating in a close-talking or speakerphone mode. In one technique, a host processor keeps track of the current operating mode of the device based on user selection. If a user selects the speakerphone option, then the host processor sets a number of device parameters such as echo cancellation thresholds, microphone sensitivity and high audio speaker output level to optimize the performance of the device in that mode. Another technique for detecting whether the phone is operating in a close-talking or speakerphone mode utilizes the outputs of gravitational sensors. According to this technique, the processor not only keeps track of the current mode, but will also switch from one operating mode to the other based on the output from the gravitational sensors.

The desired acoustical performance varies between the close-talking and speakerphone modes of operation. For optimal performance, in the close-talking mode, the phone should have a highly directional microphone behavior and in the speakerphone mode, it should have omni-directional behavior. Using traditional microphones, realizing both the close-talking mode and speakerphone mode of operation requires the use of more than one microphone and complex electronics and/or mechanical systems to close and open the noise-canceling port.

Accordingly, there is a need for an improved microphone system which can provide both noise-canceling and omni-directional capability.

BRIEF DESCRIPTION OF THE DRAWINGS

The features of the present invention, which are believed to be novel, are set forth with particularity in the appended claims. The invention, together with further objects and advantages thereof, may best be understood by reference to the following description, taken in conjunction with the accompanying drawings, in the several figures of which like reference numerals identify like elements, and in which:

DETAILED DESCRIPTION OF THE PREFERRED EMBODIMENT

Figure 1:
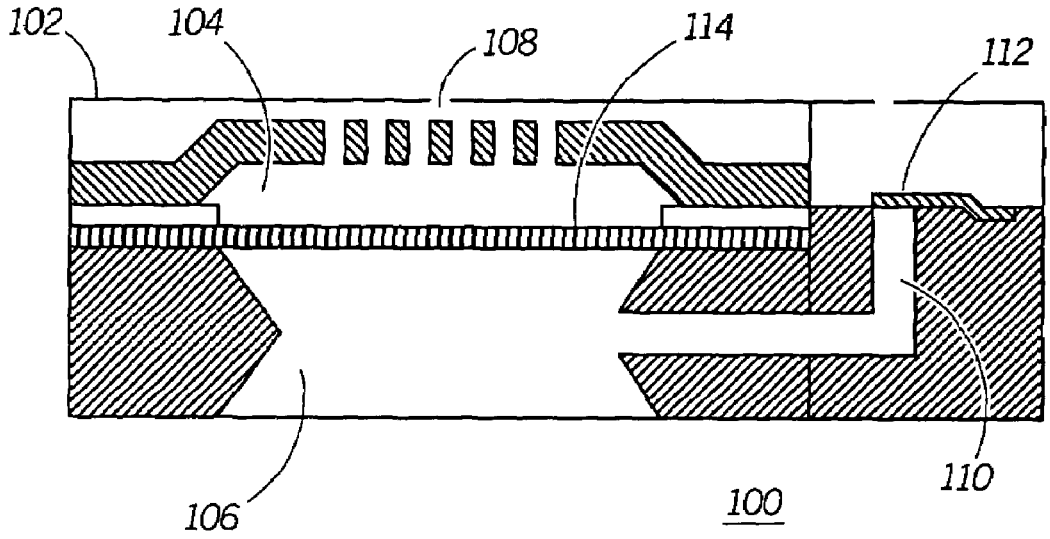
FIG. 1 is a microphone system formed in accordance with the present invention.

While the specification concludes with claims defining the features of the invention that are regarded as novel, it is believed that the invention will be better understood from a consideration of the following description in conjunction with the drawing figures, in which like reference numerals are carried forward.

In accordance with the present invention, the microphone system to be described herein provides an efficient way to realize a communication device which provides a noise-canceling mode and omni-directional mode. A user of the microphone system has the option of either manually switching between the two modes or having the communication device automatically switch the modes based on the device operating context.

Referring now to FIG. 1, there is shown a microphone system 100 in accordance with the present invention. The microphone system 100 of the present invention includes a micro electro mechanical system (MEMS) microphone 102 having a front volume portion 104 and a rear volume portion 106, a first audio port 108 accessing the front volume portion 104, a second audio port 110 accessing the rear volume portion 106 of the microphone, and a switch 112 for sealing and unsealing the second audio port 110. Second audio port 110 provides directionality to the system 100 and will also be referred to herein as directional port 110.

The switch 112 is preferably a movable MEMS switch. The microphone system 100 realizes dual microphone behavior by incorporating the movable MEMS switch 112 that closes or opens the directional port 110 thus making the microphone 102 have omni or directional behavior respectively. The directional port 110 is therefore a selectable directional port that can be enabled by closing the switch 112 and disabled by opening the switch 112. The movable MEMS switch 112 can easily be manufactured along with the microphone diaphragm 114 and other electrically active elements using the same, related or complementary MEMS process. Movable MEMS switch 112 can be formed of a variety of MEMS elements such as cantilever beams, torsional beams, sliding disks, and other MEMS elements which are well known in the art. The movable MEMS switch 112 can be controlled by a variety of means known in the art including but not limited to electrostatic, capacitive, magnetic or piezoelectric means.

In accordance with the present invention, the MEMS switch 112 shown in FIG. 1 either makes the rear volume 106 accessible to the incident acoustic waves or seals it. The MEMS microphone 102 switches from omni-directional mode to directional mode or the other way around based on the operating mode detected by a host processor (not shown) or manually by the user. For optimal cellular phone audio performance, directional mode is preferred for close-talking mode and omni-directional mode is preferred for speakerphone application. The MEMS switch 112 is preferably formed within the same MEMS package as the MEMS microphone 102. An alternative to the internal MEMS switch 112 would be to use a traditional mechanical switch located on the outside of the microphone system package to open and close the port, as will be shown in FIG. 4. The MEMS switch 112, however, has the advantage of being automatically controlled and can be integrated within the same package as the microphone diaphragm for reduced complexity.

The microphone system 100 of the present invention is easy to implement and hence has wide application in acoustics system for many communication products. The microphone system of the present invention is particularly suited for communication devices that can operate in both conventional close-talking and hands-free speakerphone modes of operation. In addition to switching from one microphone mode to the other, the microphone system 100 can, in accordance with the present invention, also adjust a variety of microphone parameters such as microphone sensitivity, microphone gain and bias voltage to further fine-tune the performance of the microphone system for a particular operating mode.

Figure 2:
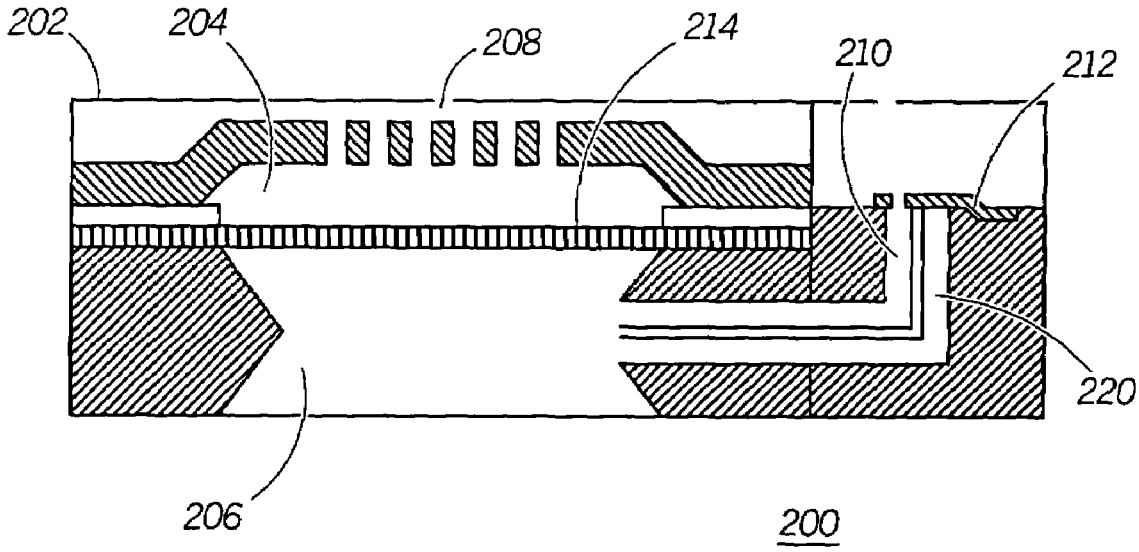
FIG. 2 is microphone system formed in accordance with an alternative embodiment of the invention.

Additional embodiments can be realized by tailoring the length and shape of the directional port 110 in different ways to alter the time delay between the front and the rear waves. The microphone system 200 of FIG. 2 includes a MEMS microphone 202 having a front volume portion 204 and a rear volume portion 206, an audio port 208 accessing the front volume portion 204, a plurality of audio ports 210, 220 for accessing the rear volume portion 206 of the microphone for directionality, and at least one switch 212 for sealing and unsealing the plurality of audio ports 210, 220. In this alternate embodiment of the invention, more than one audio port 210, 220 accesses the back volume portion 206 of a microphone system 200. Each of the audio ports 210, 220 connects to the back volume 206 with a different path length while switch 212 is used to seal and unseal the ports. The directionality of the microphone 202 can thus be varied dynamically by selecting the appropriate audio port to connect to the back volume 206 and switch position. System 200 shows switch 212 unsealing audio port 210 and sealing audio port 220. Longer path lengths increase the time delay between the audio waves reaching the front and back sides of the microphone diaphragm 214.

Figure 3:
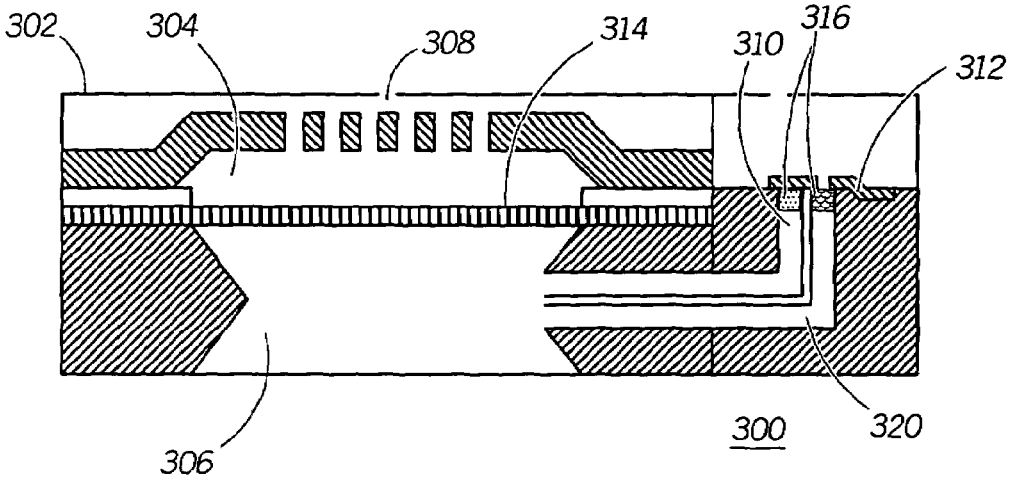
FIG. 3 is microphone system formed in accordance an alternative embodiment of the present invention.

FIG. 3 shows a microphone system 300 formed in accordance with another embodiment of the invention. The microphone system 300 includes a MEMS microphone 302 having a front volume portion 304 and a rear volume portion 306 on either side of a diaphragm 314, an audio port 308 accessing the front volume portion 304, a plurality of audio ports 310, 320 for accessing the rear volume portion 306 of the microphone for directionality, acoustic flow resistive material 316 coupled to at least one of the audio ports 310, 320 and at least one switch 312 for sealing and unsealing the plurality of audio ports 310.

In this embodiment, the time delay associated with each of the audio ports 310 accessing the back volume portion 306 is realized through a combination of the delay associated with the acoustic flow resistive material 316 and the path length of the ports 310, 320. System 300 shows switch 312 sealing audio port 310 and unsealing audio port 320. In this embodiment, it possible to have the same path length for each of the ports 310, 320 and still realize different time delays through use of different acoustic flow resistive material in the ports. Examples of such resistive material include, but are not limited to GAW102, GAW103, GAW101, GAW104, GAW301, GAW314 grade acoustic protective materials manufactured by W. L. Gore & Associates, Inc. of Elkton, Md. Thus when the directional port(s) 310 is unsealed, acoustic waves reaching the back volume are delayed by a predetermined amount of time based on the flow resistivity characteristics of the resistive material and the path length of the second audio port. Alternatively, the resistive material 316 can be positioned on the other side of the switch 312. The use of different path lengths along with different materials thus provides further dynamic variation of the microphone directionality.

Figure 4:
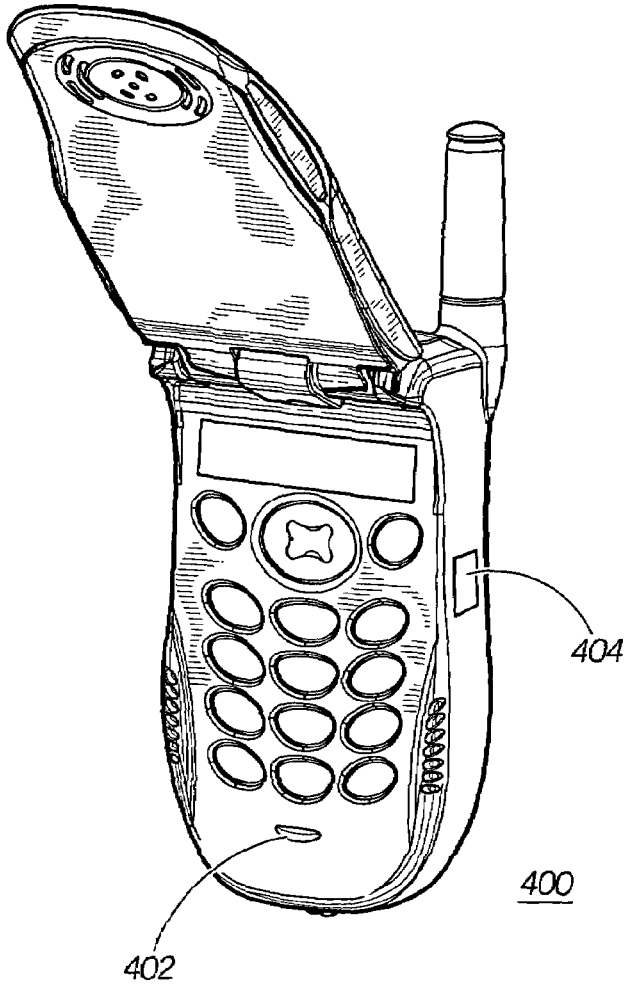
FIG. 4 is a communication device formed in accordance with the present invention.

FIG. 4 shows a communication device 400 having a microphone system formed in accordance with the present invention. Techniques such as those previously described can be used to detect whether the phone is operating in a close-talking (close to mouth) mode or speakerphone (handsfree) mode. In accordance with the present invention, microphone 402 switches between handsfree mode and close-talking mode either automatically via an internal controller or manually through a user selectable switch 404.

Accordingly, there has been provided a microphone system that enables a high quality audio experience in the hands-free mode as well as the close-talking mode of a communication device. The use of a MEMS microphone in conjunction with at least one audio port coupled to the MEMS microphone provides directional functionality and the ability to switch between two microphone modes using a single microphone. By utilizing additional ports along with varying the path lengths and/or using different acoustic flow resistance material in the ports, the microphone system can provide further dynamic variation of the directionality and time delay. Thus, the microphone system of the present invention provides dynamic acoustic control of the audio in addition to the ability to switch between hands-free mode and close-talking mode.

The microphone system of the present invention also provides significant advantages over traditional microphone systems in that it can be implemented within a communication device using automated assembly practices. The MEMS microphone need only be mounted to one side of a board thereby simplifying the entire assembly as compared to standard electret microphones which are typically mounted via through holes on a printed circuit board (PCB) or flex assembly. Since MEMS devices are smaller and slimmer in size than standard electret microphones, the microphone system of the present invention takes up less space than standard microphone assemblies.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A microphone system, comprising:

a MEMS microphone having a front volume portion and a rear volume portion;

a first audio port accessing the front volume portion;

a second audio port accessing the rear volume portion of the microphone; and a movable MEMS switch for automatically sealing and unsealing the second audio port in response to operating context, the MEMS microphone, the first audio port, the second audio port and the movable MEMS switch being incorporated into a single package.

2. The microphone system of claim 1, wherein the movable switch automatically switches the microphone between directional functionality and omni-directional functionality.

3. The microphone system of claim 1, further comprising a third audio port accessing the rear volume portion of the microphone, the second and third audio ports being of different lengths.

4. The microphone system of claim 3, wherein at least one of the second and third audio ports has an acoustic flow resistive material coupled thereto.

5. The microphone system of claim 3, wherein the second and third audio ports have different acoustic flow resistive materials coupled thereto.

6. The microphone system of claim 1, further comprising an acoustic flow resistive material coupled to the second audio port.

7. The microphone system of claim 6, wherein the acoustic flow resistive material is coupled to the second audio port such that when the port is unsealed, acoustic waves are delayed by a predetermined amount of time based on flow resistivity characteristics of the resistive material and a path length of the second audio port.

* * * * *